US010718569B2

(12) United States Patent
Tomita et al.

(10) Patent No.: US 10,718,569 B2
(45) Date of Patent: Jul. 21, 2020

(54) HEAT TREAT FURNACE JIG

(71) Applicant: TOYO TANSO CO., LTD., Osaka-shi, Osaka (JP)

(72) Inventors: Syuhei Tomita, Mitoyo (JP); Hiroshi Machino, Mitoyo (JP); Toshiharu Hiraoka, Mitoyo (JP); Shingo Bito, Mitoyo (JP)

(73) Assignee: TOYO TANSO CO., LTD., Osaka (JP)

( * ) Notice: Subject to any disclaimer, the term of this patent is extended or adjusted under 35 U.S.C. 154(b) by 140 days.

(21) Appl. No.: 14/896,027

(22) PCT Filed: Jun. 4, 2014

(86) PCT No.: PCT/JP2014/064868
§ 371 (c)(1),
(2) Date: Dec. 4, 2015

(87) PCT Pub. No.: WO2014/196574
PCT Pub. Date: Dec. 11, 2014

(65) Prior Publication Data

US 2016/0123670 A1 May 5, 2016

(30) Foreign Application Priority Data

Jun. 6, 2013 (JP) ..... 2013-119645

(51) Int. Cl.
*F27D 5/00* (2006.01)
*D03D 15/12* (2006.01)
(Continued)

(52) U.S. Cl.
CPC ..... *F27D 5/0006* (2013.01); *C21D 9/0025* (2013.01); *D03D 1/00* (2013.01);
(Continued)

(58) Field of Classification Search
CPC ..... F27D 2003/121; F27D 2005/0081; F27D 3/0024; F27D 3/022; F27D 3/024;
(Continued)

(56) References Cited

U.S. PATENT DOCUMENTS 2,765,159 A * 10/1956 Garofalo ..... C21D 9/0025 29/897.15
2,807,454 A * 9/1957 Beadle ..... B65D 21/0211 126/9 B
(Continued)

FOREIGN PATENT DOCUMENTS

CN 1836054 A 9/2006
CN 202626543 * 12/2012 ..... C21D 9/0025
(Continued)

OTHER PUBLICATIONS

Office Action dated Apr. 26, 2017, issued in counterpart Taiwanese Application No. 103119741, with English translation (9 pages).
(Continued)

*Primary Examiner* — Scott R Kastler
*Assistant Examiner* — Michael Aboagye
(74) *Attorney, Agent, or Firm* — Greenblum & Bernstein, P.L.C.

(57) ABSTRACT

The present invention improves the strength of the bottom (net) of the jig and makes it more difficult and unlikely for deviation of the mesh to occur.

A workpiece is loaded on the net (2) of the heat treat furnace jig (hereinafter, heat treatment furnace jig). In the net (2), a first strand (10), a second strand (20) and a third strand (30) are in contact at a contact point (X1). Near the contact point (X1), the second strand (20) overlaps the first strand (10) from above and the third strand (30) overlaps the first strand
(Continued)

(10) from below. As a result, the first strand (10) is held between the second strand (20) and the third strand (30) in the up/down directions.

19 Claims, 6 Drawing Sheets

(51) Int. Cl.

| | |
|---|---|
| ***F27D 3/02*** | (2006.01) |
| ***D03D 1/00*** | (2006.01) |
| ***D03D 13/00*** | (2006.01) |
| ***D03D 19/00*** | (2006.01) |
| ***C21D 9/00*** | (2006.01) |
| ***F27D 3/12*** | (2006.01) |
| ***F27D 3/00*** | (2006.01) |

(52) U.S. Cl.
CPC ..... *D03D 13/002* (2013.01); *D03D 15/12* (2013.01); *D03D 19/00* (2013.01); *F27D 3/0024* (2013.01); *F27D 3/022* (2013.01); *F27D 3/024* (2013.01); *F27D 3/12* (2013.01); *F27D 5/0012* (2013.01); *D10B 2101/12* (2013.01); *D10B 2505/00* (2013.01); *F27D 2003/121* (2013.01); *F27D 2005/0081* (2013.01)

(58) Field of Classification Search
CPC ..... F27D 3/12; F27D 5/0006; F27D 5/0012; C21D 9/0025; D03D 3/002; D03D 5/12; D03D 9/00; D03D 1/00; D10B 2101/12; D10B 2505/00
USPC ..... 266/275, 274, 279, 286; 428/293.4
See application file for complete search history.

(56) References Cited

U.S. PATENT DOCUMENTS

| | | | | |
|---|---|---|---|---|
| 3,606,815 | A | 9/1971 | Yamashita et al. | |
| 5,418,063 | A * | 5/1995 | Booth | C04B 35/83 427/113 |
| 7,175,787 | B2 * | 2/2007 | Ebert | B29C 70/34 156/245 |
| 7,316,175 | B2 * | 1/2008 | Safwat | A01K 75/00 87/53 |
| 7,740,474 | B2 * | 6/2010 | Scheibel | C21D 9/0025 432/258 |
| 8,857,652 | B2 * | 10/2014 | Lewis | A47J 36/16 220/573.4 |
| 2002/0162624 | A1 | 11/2002 | Ebert et al. | |
| 2006/0199132 | A1 | 9/2006 | Scheibel et al. | |
| 2009/0211517 | A1 * | 8/2009 | Kato | C30B 15/10 117/200 |

FOREIGN PATENT DOCUMENTS

| | | | |
|---|---|---|---|
| CN | 202626543 | U | 12/2012 |
| EP | 2123800 | A1 | 11/2009 |
| EP | 2135976 | A2 | 12/2009 |
| EP | 2554526 | A1 | 2/2013 |
| JP | 10-168699 | A | 6/1998 |
| JP | 11-50704 | A | 2/1999 |
| JP | 2006-527351 | A | 11/2006 |
| JP | 2010-286153 | A | 12/2010 |
| TW | 200936822 | A | 9/2009 |

OTHER PUBLICATIONS

International Search Report dated Jul. 15, 2014, issued in counterpaart Application No. PCT/JP2014/064868 (2 pages).
Extended European Search Report dated Jan. 20, 2017, issued in counterpart European Application No. 4806927.1. (8 pages).
Office Action dated Sep. 30, 2017, issued in Taiwanese Application No. 103119741, with English translation (11 pages).
Office Action dated Mar. 5, 2018, issued in counterpart European Application No. 14 806 927.1 (4 pages).

* cited by examiner

HEAT TREAT FURNACE JIG

TECHNICAL FIELD

The present invention relates to a heat treat furnace jig (hereinafter, heat treatment furnace jig) used for heat-treating a workpiece in a heat treatment furnace.

BACKGROUND ART

In various heat treatments such as carburizing and quenching, a workpiece is placed on a jig while being heat-treated. As an example of such a jig, PTL 1 discloses a jig including a meshed bottom on which a workpiece is placed, and a quadrangular frame configured to hold the bottom. The bottom is made of a plainly woven net in which longitudinal fiber strands and traversal fiber strands are alternately intersecting. The net is manufactured by fixing the fiber strands to the frame.

CITATION LISTING

Patent Literature

[PTL 1] Publication of Japanese Translation of PCT international application No. 2006-527351 (Tokuhyou 2006-527351)

DISCLOSURE OF THE INVENTION

Technical Problem

The bottom (net) of the jig preferably has a high strength for the purpose of stably hold a workpiece. For this reason, there has been an approach of impregnating the net with a matrix material, to strengthen the net. However, the net of PTL 1 simply has the longitudinal fiber strands and the traversal fiber strands intersecting each other, and the adhesive force at each intersection is weak even with impregnation of a matrix material. The net therefore easily deforms in a horizontal direction or in a vertical direction, once it is taken off from the frame. Such a net falls short for sufficiently supporting a workpiece, and is significantly inconvenient, when conducting a heat treatment to a metal product and the like.

Further, when the mesh deviates in a horizontal direction due to a weak adhesive force between intersecting fiber strands, the area with a small mesh may form. When a workpiece and the jig is immersed an oil coolant for example, a passage for the oil coolant is not ensured in such an area, which may consequently result in insufficient immersing of the workpiece the oil coolant.

In view of the above, an object of the present invention is to provide a heat treat furnace jig (hereinafter, heat treatment furnace jig) with an improved strength of the net (bottom of the jig), in which deviation of a mesh hardly occurs.

Technical Solution

An aspect of the present invention is a heat treat furnace jig (hereinafter, heat treatment furnace jig) including a net of woven strands which are each a bundle of carbon fibers, wherein the net is impregnated with a matrix material, and among the plurality of strands, strands of at least one direction are each held by two strands of another direction.

With the above aspect of the present invention, each strand of the net is held by two other strands, and the adhesive force at each intersection of the net is improved, thereby preventing deviation of meshes while strengthening the net itself. This ensures passages for an oil coolant at a time of dipping the heat treatment furnace jig into an oil tank while enabling stable holding of a workpiece and a long lasting usage.

In the above aspect of the present invention, the net is preferably a triaxial woven fabric. Alternatively, the net is preferably a biaxial woven fabric and intertwined strands are used for at least one axis, each of the intertwined strands formed by twisting together said strands.

With the above structure, the net is strengthened and the deviation of the mesh is restrained with a simple structure, without a need of providing a frame in an outer peripheral portion.

Further, when the net is triaxial woven fabric, it is preferable that among the plurality of strands, one side line of a first axial strand contact a vertex of a first area of a quadrangular area where a second axial strand and a third axial strand overlap with each other, and another side line of the first axial strand contact a vertex of a second area of a quadrangular area where another second axial strand parallel and adjacent to aforementioned second axial strand overlaps with the third axial strand overlap with each other.

With the above structure in which the strand of the first axis is held from both sides by strands of the second axis and the third axis, the net is strengthened and the deviation of the meshes is restrained with a simple structure.

Another aspect of the present invention is a heat treatment furnace jig including a net of woven strands which are each a bundle of carbon fibers, wherein the net is impregnated with a matrix material, and a knot is formed at each intersecting portion of the strands extended in at least two different directions.

With the above aspect of the present invention, two or more strands are knotted at their intersection, and the adhesive force at each intersection of the net is improved, thereby preventing deviation of meshes while strengthening the net itself. This ensures passages for an oil coolant at a time of dipping the heat treatment furnace jig into an oil tank while enabling stable holding of a workpiece and a long lasting usage.

It is preferable that the matrix material mainly contain carbon. Example of such carbon includes carbon derived from pitch or a resin, pyrolytic carbon, and the like.

The thermal expansion coefficient of the matrix material mainly comprised of carbon is not so much different from the thermal expansion coefficient of carbon fibers. Therefore, generation of internal stress is suppressed at the time of manufacturing or using the net. Further, since such a matrix material hardly reacts with carbon fibers, the strength of the carbon fibers remains unspoiled. For these reasons, a matrix material mainly comprised of carbon is suitable for use as the matrix material in the present invention. Examples of such carbon contained in the matrix material include carbon obtainable through various methods such as carbon derived from pitch or a resin and gas-phase pyrolytic carbon.

Advantageous Effect

The present invention improves the strength of the bottom (net) of a jig, while restraining deviation in the meshes.

DESCRIPTION OF EMBODIMENTS

The following describes an embodiment of the present invention.

In the embodiment of the present invention is described a heat treat furnace jig (hereinafter, heat treatment furnace jig) 100, with reference to FIG. 1A, FIG. 1B, FIG. 2A and FIG. 2B.

Figure 1A:
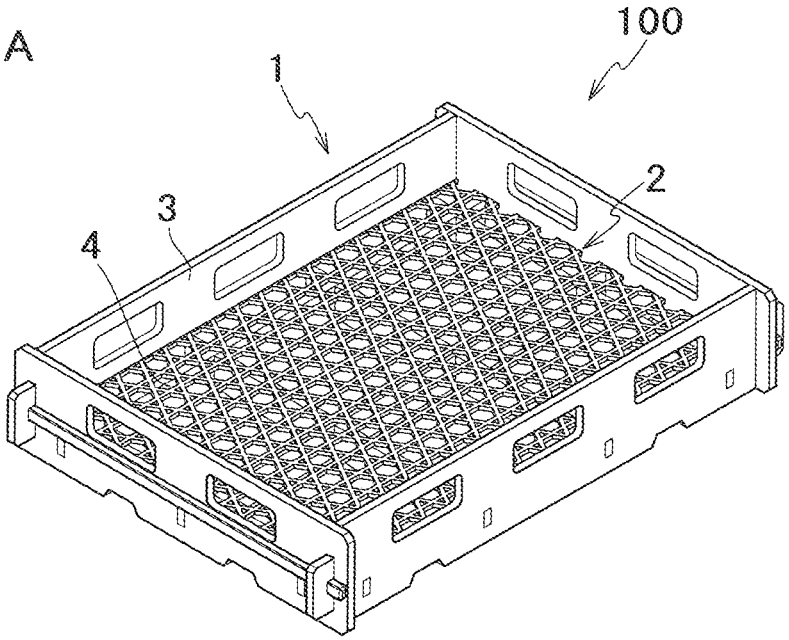
FIG. 1A is a perspective view of an assembled heat treatment furnace jig related to a first embodiment of the present invention.
Figure 1B:
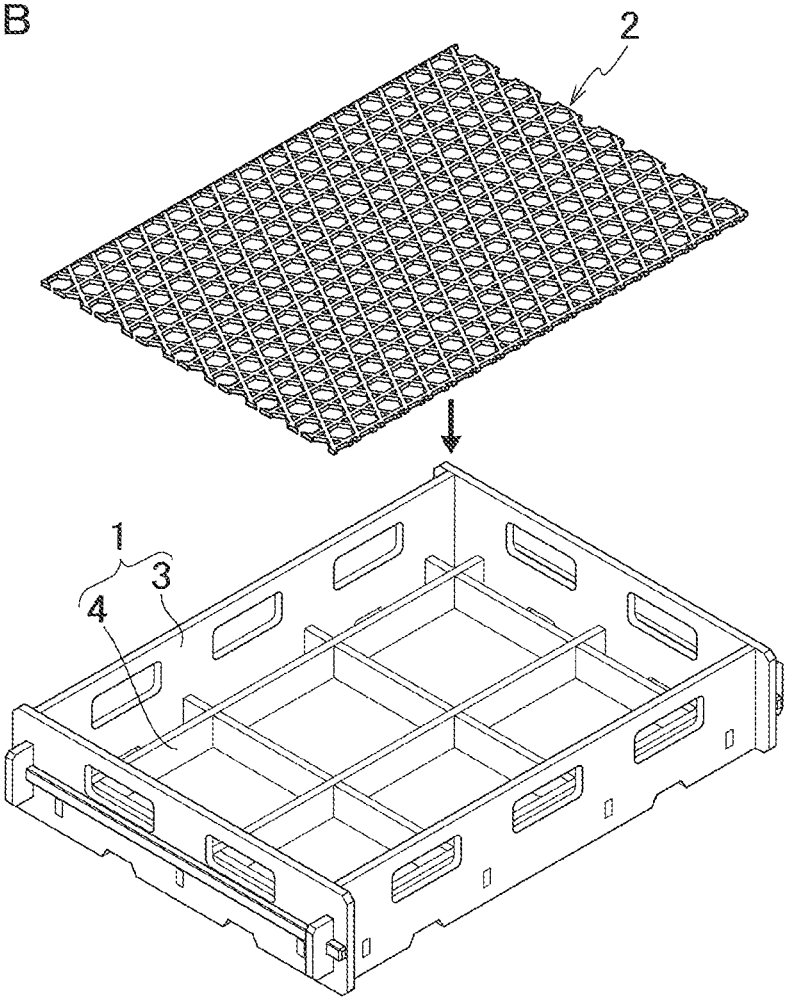
FIG. 1B is a perspective view of the heat treatment furnace jig before assembly, which is related to a first embodiment of the present invention.

The heat treatment furnace jig 100 includes: a box-like frame 1 and a net 2 disposed in the frame 1, as shown in FIG. 1A. The frame 1 has a rim part 3 in a quadrangular shape which surrounds the net 2. Within the rim part 3, planner members 4 are arranged in a grid, forming the bottom part of the frame 1, as shown in FIG. 1B. On the planner members 4 are disposed the net 2. In a heat treatment furnace, heat treatment such as carburizing, carbonitriding, quenching, and annealing is conducted while a workpiece (not shown) is placed on the net 2.

Figure 2A:
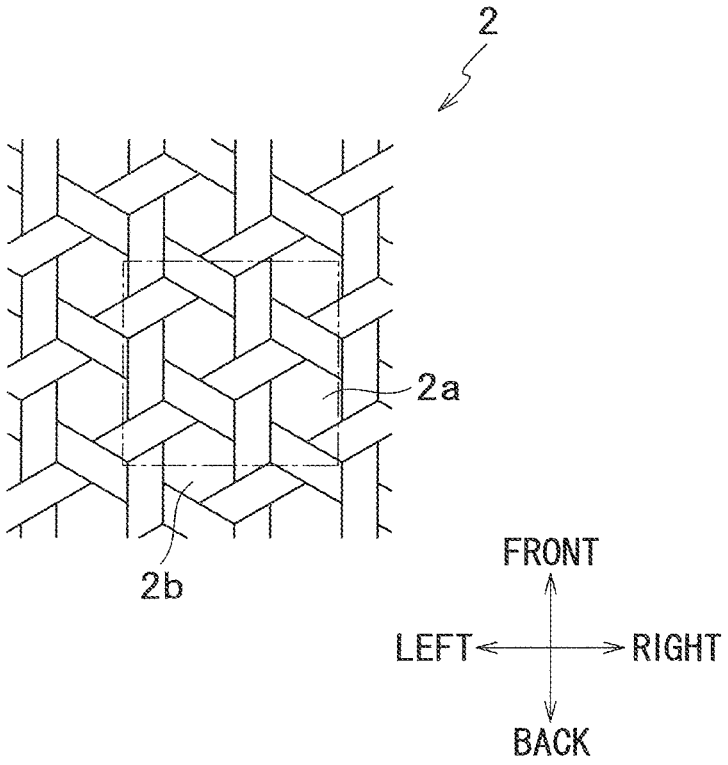
FIG. 2A is a plan view of a net shown in FIG. 1A.

The net 2 is triaxial woven fabric made of a plurality of strands woven in 3 directions, and has hexagonal meshes 2*a*, 2*b* . . . , as shown in FIG. 2A. Each strand includes a plurality of carbon fibers aligned without twisting.

Further, the net 2 is impregnated with a matrix material. The matrix material is preferably a matrix material whose strength is hardly deteriorated even under high temperatures of 500° C., and is preferably carbon, ceramics such as SiC, $SiN_4$, and $Al_2O_3$, metals, particularly preferably metals having a melting point of 1000° C. or higher, such as Cr, Ni, W, an alloy of any of these metals, and a combination of these. Of the above, it is further preferable that the matrix material mainly contain a carbon component including gas-phase pyrolytic carbon, carbon derived from pitch or from a resin. The matrix material mainly comprised of carbon reduces reactions between the matrix material and carbon fibers, and the thermal expansion coefficients of the matrix material and the carbon fibers are approximated with each other thus leading to an improved adhesive force between the matrix material and the carbon fibers. Further, a net 2 with a high strength is obtainable. A matrix material mainly containing carbon mainly comprised of carbon is obtained by carbonizing a matrix material that are impregnated with pitch or a resin, or through a thermal decomposition process (gas-phase thermal decomposition process) by letting an ingredient gas such as a hydrocarbon gas flow at high temperatures. Of the above, the gas-phase thermal decomposition process is preferable, because it does not require a work for removing redundant carbon from the net after the matrix material is impregnated. The gas-phase pyrolytic carbon may be a typical thermal CVD method; however, a CVI method is preferable. This way, carbon obtained by the thermal cracking process is impregnated not only into the surface of the strands, but also among the carbon fibers structuring each strand, and into intersecting portions where the carbon fibers contact one another. Further, by controlling the impregnation, there will be no need for a removal of redundant carbon.

Figure 2B:
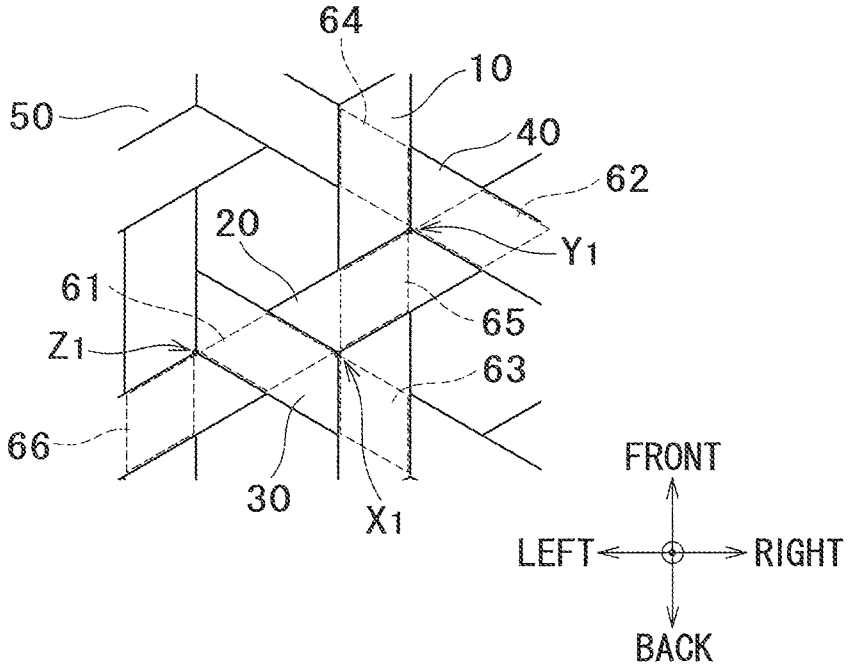
FIG. 2B is a partially enlarged view of FIG. 2A.

In the net 2, three strands 10, 20, and 30 intersect with one another at a contact point $X_1$, as shown in FIG. 2B. A first strand 10 extends in a front/back direction, a second strand 20 extends in the front right direction (or back left direction), and a third strand 30 extends in the back right direction (or front left direction).

Further, at a contact point $Y_1$ on the front right of the contact point $X_1$, three strands 10, 20, and 40 are in contact with one another. A fourth strand 40 extends in the back right direction (or front left direction), and is parallel to the third strand 30. The fourth strand 40 is disposed next to the third strand 30.

The contact point $X_1$ is on the left from the middle line of the first strand 10, and the contact point $Y_1$ is on the right from the middle line.

At the contact point $X_1$ where the second strand 20 and the third strand 30 intersect, the second strand overlaps the first strand 10 from above, and the third strand 30 overlaps the first strand 10 from below. With this structure, the second strand 20 and the third strand 30 positioned differently relative to the front/back direction hold the first strand 10 in up/down directions. By up/down directions, it means directions perpendicular to the plane of the net 2.

At the contact point $Y_1$ where the second strand 20 and the fourth strand 40 intersect, the second strand overlaps the first strand 10 from above, and the fourth strand 40 overlaps the first strand 10 from below. With this structure, the second strand 20 and the fourth strand 40 positioned differently relative to the front/back direction hold the first strand 10 in the up/down directions.

Further, at the contact point $X_1$, the left side line of the first strand contacts the right vertex (contact point $X_1$) of a rhomboid area 61 where the second strand 20 and the third strand 30 overlap with each other. Further, at the contact point $Y_1$, the right side line of the first strand contacts the left vertex (contact point $Y_1$) of a rhomboid area 62 where the second strand 20 and the fourth strand 40 overlap with each other. This way, the first strand 10 is held in the left/right directions nearby the contact points $X_1$ and $Y_1$, by the second strand 20, the third strand 30, and the fourth strand 40.

Thus, the first strand 10 is held in the up/down directions and the left/right directions by the strands 20, 30, and 40 extending in other directions, nearby the contact points $X_1$ and $Y_1$.

Further, nearby the contact points $X_1$ and $Y_1$, the strand 20 is held by the strands 10, 30, and 40 in the up/down directions, as shown in FIG. 2B. At the contact point $X_1$, the back side line of the second strand 20 contacts the front vertex (contact point $X_1$) of a rhomboid area 63 where the first strand 10 and the third strand 30 overlap with each other. Further, at the contact point $Y_1$, the front side line of the second strand contacts the back vertex (contact point $Y_1$) of a rhomboid area 64 where the first strand 10 and the fourth strand 40 overlap with each other. This way, the second strand 20 is held in the front/back directions nearby the contact points $X_1$ and $Y_1$, by the first strand 10, the third strand 30, and the fourth strand 40.

Thus, the second strand 20 is held in the up/down directions and the front/back directions by the strands 10, 30, and 40 extending in other directions, nearby the contact points $X_1$ and $Y_1$.

Further, nearby the contact points $X_1$ and $Z_1$, the strand 30 is held by the strands 10, 20, and 50 in the up/down directions, as shown in FIG. 2B. The contact point $Z_1$ is a point where three strands 20, 30, and 50 contact one another. A fifth strand 50 extends in the front/back direction, and is parallel to the first strand 10. The fifth strand 50 is disposed next to the first strand 10.

At the contact point $X_1$, the front side line of the third strand 30 contacts the back vertex (contact point $X_1$) of a rhomboid area 65 where the first strand 10 and the second strand 20 overlap with each other. Further, at the contact point $Z_1$, the back side line of the third strand 30 contacts the front vertex (contact point $Z_1$) of a rhomboid area 66 where the second strand 20 and the fifth strand 50 overlap with each other. This way, the third strand 30 is held in the front/back directions nearby the contact points $Y_1$ and $Z_1$, by the first strand 10, the second strand 20, and the fifth strand 50.

Thus, the third strand 30 is held in the up/down directions and the front/back directions by the strands 10, 20, and 50 extending in other directions, nearby the contact points $Y_1$ and $Z_1$.

Thus, nearby the contact points of three strands, the strands are all restrained from deviating in the front/back directions, the left/right directions, and the up/down directions. Therefore, deviation of meshes hardly takes place in the net 2.

As described hereinabove, the heat treatment furnace jig 100 of the present embodiment brings about the following effects. With the present invention, a strand (10) of the net 2 is held in the up/down directions by two other strands (20, 30), and the adhesive force at an intersection of the net 2 is improved, thereby preventing deviation of meshes 2*a*, 2*b* . . . while strengthening the net 2 itself. This ensures passages for an oil coolant at a time of dipping the heat treatment furnace jig 100 into an oil tank and enables a workpiece to be stably held, while allowing a long lasting usage.

Further, the prevention of deviation in the meshes 2*a*, 2*b* . . . and strengthening of the net 2 are possible without a need of firmly fixing the strands 10, 20, and 30 to the rim part 3, or stretching the strands 10, 20, and 30.

Further, in cases of a net 2 made of a triaxial woven fabric, one side line of the strand (10) contacts intersecting two strands (20, 30), and the other side line of the strand (10) contacts intersecting two strands (20, 40), thereby holding the strand (10) from the both sides. This way, the strand is held in the front/back directions and the left/right directions, which further restrains deviation in the meshes.

Further, the net 2 is strengthened by a simple method of impregnating the net 2 with a matrix material mainly comprised of carbon.

Second Embodiment

Figure 3:
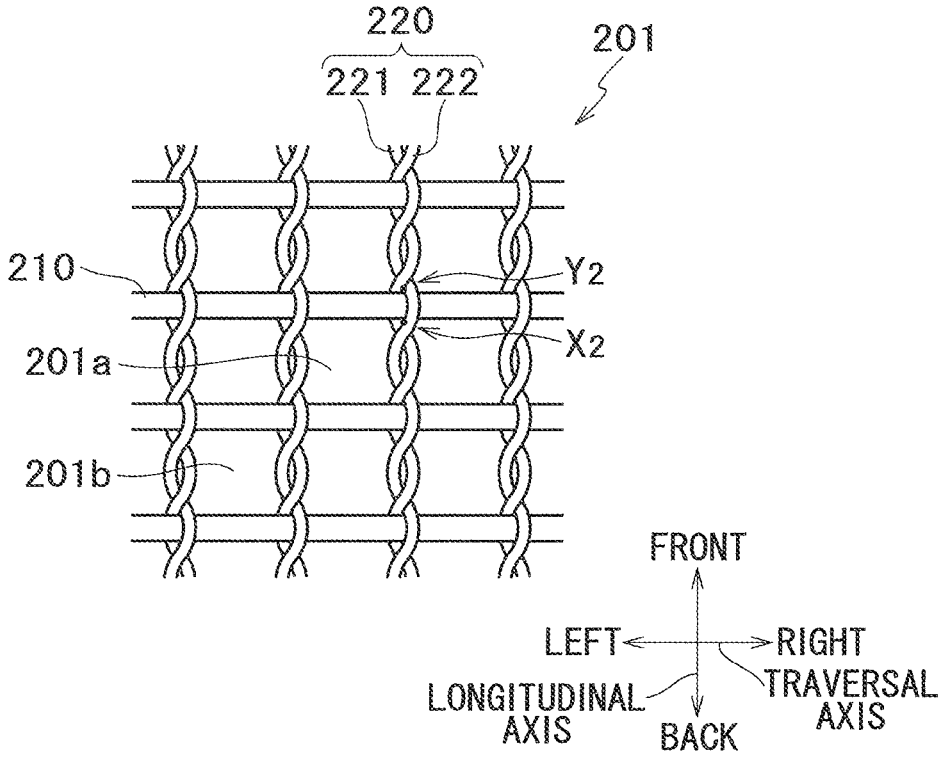
FIG. 3 is a partially enlarged view of a net of a heat treatment furnace jig related to a second embodiment.

Next, the following describes a second embodiment with reference to FIG. 3. The second embodiment differs from the first embodiment in the structure of a net 201.

The net 201 is biaxial woven fabric having quadrangular meshes 201*a* and 201*b*. Each strand includes a bundle of carbon fibers. Further, the net 201 is impregnated with a matrix material.

Traversal strands 210 each includes a plurality of carbon fibers aligned without twisting. On the other hand, in each longitudinal strand (intertwined strand) 220, the two strands 221 and 222 are leniently twisted once (360° twist) between two successive traversal strands. The traversal strand 210 runs between two longitudinal strands 221 and 222.

Three strands, i.e., the traversal strand 210 and the longitudinal strands 221 and 222 are in contact with each other at contact points $X_2$ and $Y_2$. The contact point $X_2$ and the contact point $Y_2$ are positioned opposite to each other over the longitudinal strand 210.

Between the contact points $X_2$ and $Y_2$, the traversal strand 210 is held by the longitudinal strands 221 and 222 in radial directions (directions perpendicularly crossing the plane of the net 201 (up/down directions)).

Further, at the contact point $X_2$, the front side line of the traversal strand 210 contacts an area where the longitudinal strands 221 and 222 intersect. On the other hand, at the contact point $Y_2$, the back side line of the traversal strand 210 contacts an area where the longitudinal strands 221 and 222 intersect. As a result, the traversal strand 210 is held in the front/back directions by the longitudinal strands 221 and 222.

In the above structure, the longitudinal strands 221 and 222 hold the traversal strand 210 in the up/down directions and the front/back directions, in the vicinity of contact points $X_2$ and $Y_2$, i.e., portions forming corners of quadrangular meshes 201*a*. Further, the longitudinal strands 221 and 222 hold the traversal strand 210 in the up/down directions and the front/back directions, at portions forming the other corners. Thus, the strand 210 is restrained from deviating in the up/down directions or in the front/back directions, around corners of all the meshes. Further, the longitudinal strands 221 and 222 holding the traversal strand 210 in the up/down directions also restrains deviation relative to the left/right directions. Further, twisting the strands 221 and 222 generates an untwisting force, which leads to a force for gripping the traversal strand 210. This further restrains the strand 210 from deviating.

Thus, the present embodiment adopting a biaxial woven fabric as the net 201*a* prevents the meshes 201*a*, 201*b*, . . . from deviating without a need of fixing the net 201 to the frame, while strengthening the net 201 itself.

[Modification 1]

Figure 4:
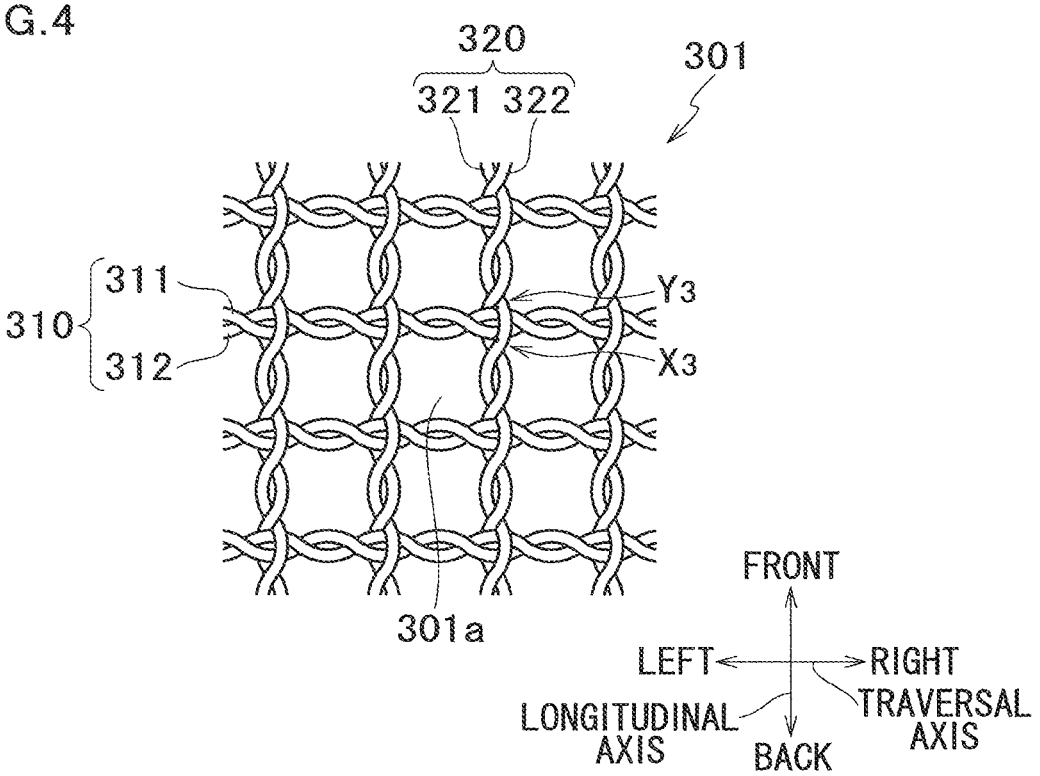
FIG. 4 is a partially enlarged view of a net of a modification of the second embodiment.

Next, the following describes a modification of the second embodiment with reference to FIG. 4. The modification 1 is different from the second embodiment in that a net 301 uses an intertwined strand 310 for its traversal strands.

In each traversal intertwined strand 310, two strands 311 and 312 each of which is a bundle of carbon fibers are leniently intertwined. In each longitudinal intertwined strand 320, two strands 321 and 322 each of which is a bundle of carbon fibers are leniently intertwined. The traversal intertwined strand 310 runs between longitudinal strands 321 and 322.

As shown in FIG. 4, three strands, i.e., the traversal strand 311 and the longitudinal strands 321 and 322 are in contact with each other at a contact point $X_3$. Three strands, i.e., the traversal strand 312 and the longitudinal strands 321 and 322 are in contact with each other at a contact point $Y_3$. The contact point $X_3$ and the contact point $Y_3$ are positioned opposite to each other over the intertwined strand 310.

Between the contact points $X_3$ and $Y_3$, the traversal strands 311 and 312 are sandwiched by the longitudinal strands 321 and 322 in radial directions (directions perpendicularly crossing the plane of the net 301 (up/down directions)).

Further, at the contact point $X_3$, the back side line of the traversal strand 311 contacts an area where the longitudinal strands 321 and 322 intersect. On the other hand, at the contact point $Y_3$, the front sideline of the traversal strand 312 contacts an area where the longitudinal strands 321 and 322 intersect. As a result, the traversal strands 311 and 312 are held in the front/back directions by the longitudinal strands 321 and 322.

In the above structure of the modification 1, the longitudinal intertwined strand 320 holds the traversal intertwined strand 310 in the up/down directions and the front/back directions, in the vicinity of contact points $X_3$ and $Y_3$, i.e., portions forming corners of quadrangular meshes 301*a*. Thus, the intertwined strand 310 is restrained from deviating in the up/down directions or in the front/back directions, corners of the meshes 301*a*. Further, the longitudinal intertwined strand 320 holding the traversal intertwined strand 310 in the up/down directions also restrains deviation relative to the left/right directions.

Thus, similarly to the second embodiment, the present modification adopting a biaxial woven fabric as the net 301 prevents the meshes 301*a* from deviating without a need of fixing the net 301 to the frame, while strengthening the net 301 itself.

Third Embodiment

Figure 5:
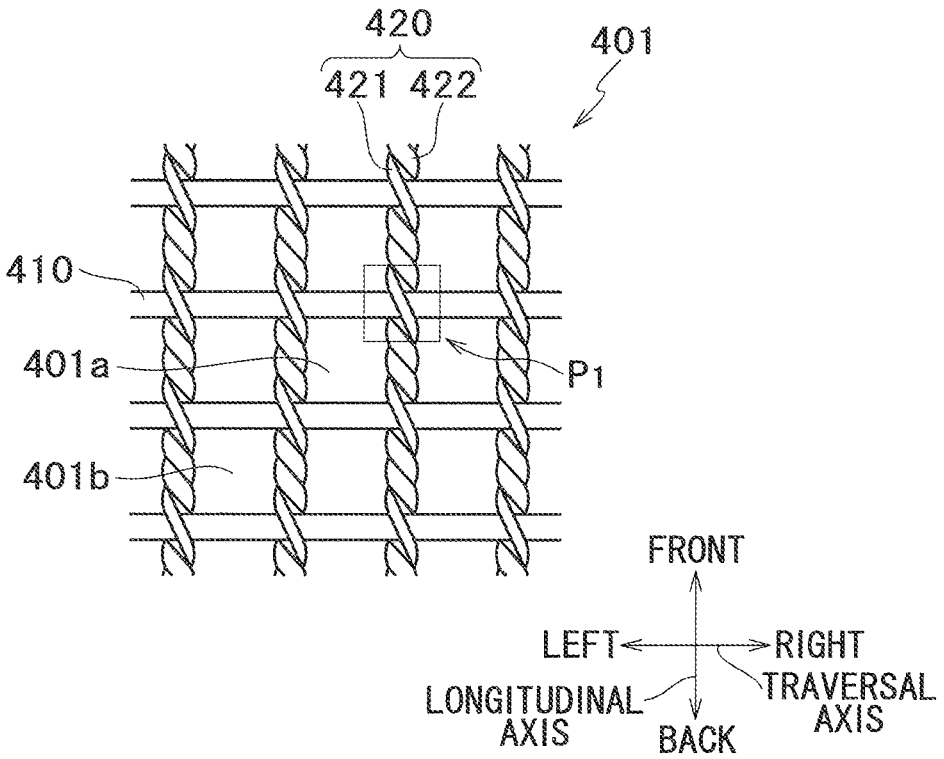
FIG. 5 is a partially enlarged view of a net of a heat treatment furnace jig related to a third embodiment.

Next, the following describes a third embodiment with reference to FIG. 5. The third embodiment differs from the first embodiment in the structure of a net 401.

The net 401 is biaxial woven fabric having quadrangular meshes 401*a*, 401*b* . . . . Each strand includes a bundle of carbon fibers. Further, the net 401 is impregnated with a matrix material.

Traversal strands 410 each includes a plurality of carbon fibers aligned without twisting. On the other hand, a longitudinal intertwined strand 420 is formed by twisting two strands 421 and 422. The number of twists in the intertwined strand 420 is more than that of the intertwined strand 220 of the second embodiment. The strength of the intertwined strand 420 is therefore higher than that of the intertwined strand 220. The traversal strand 410 runs between longitudinal strands 421 and 422.

In a portion $P_1$ where the traversal strand 410 and the longitudinal intertwined strand 420 overlap with each other, the traversal strand 410 is held by the longitudinal strands 421 and 422 in up/down directions (directions perpendicularly crossing the plane of the net 401).

In the above structure, the traversal strand 410 hardly deviates at the portion $P_1$ where the strands 410 and 420 of two axes overlap with each other, i.e., portions forming corners of quadrangular meshes 401*a*.

Thus, the present embodiment adopting a biaxial woven fabric as the net 401*a* prevents the meshes 401*a* from deviating without a need of fixing the net 401 to the frame, while strengthening the net 401 itself. Further, when the present embodiment is compared with the net 201 of the second embodiment, the number of twists of the intertwined strand 420 (longitudinal axis) is more than that of the intertwined strand 220 (longitudinal axis) of the second embodiment. As such, this embodiment achieves a higher strength than that of the net 201 of the second embodiment while restraining deviation of the meshes 401*a*.

[Modification 2]

Figure 6:
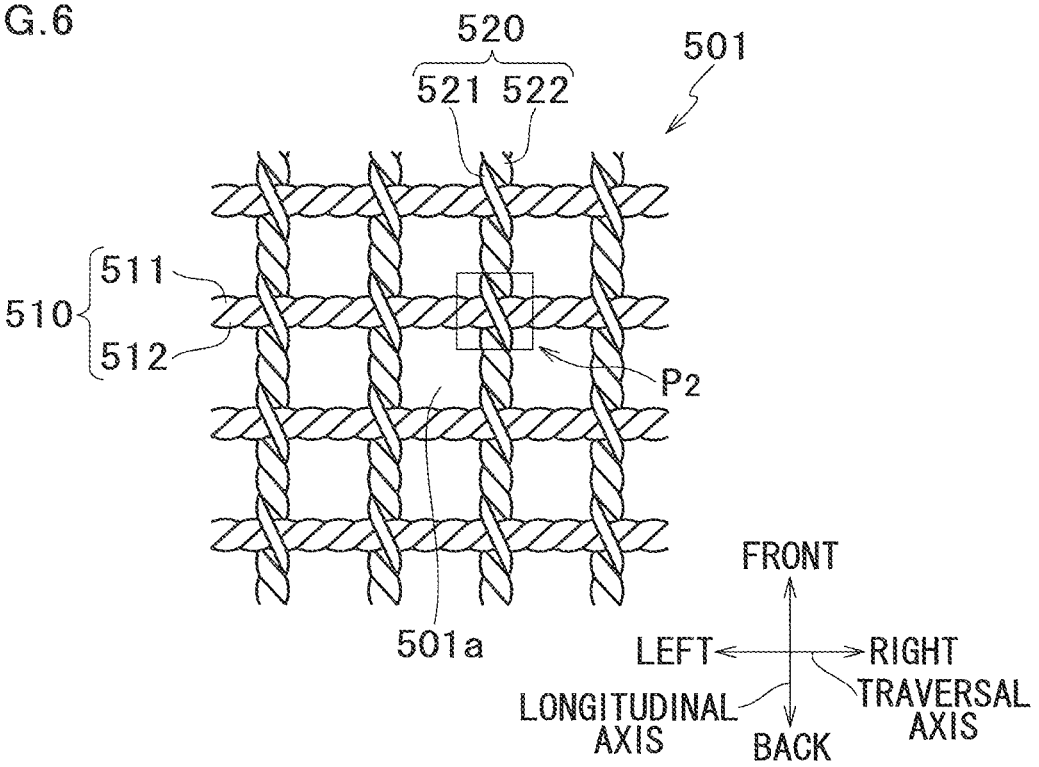
FIG. 6 is a partially enlarged view of a net of a modification of the third embodiment.

Next, the following describes a modification 2 with reference to FIG. 6. The modification 2 is different from the third embodiment in that a net 501 uses an intertwined strand 510 for its traversal strands.

In each traversal intertwined strand 510, two strands 511 and 512 each of which is a bundle of carbon fibers are intertwined. In each longitudinal intertwined strand 520, two strands 521 and 522 each of which is a bundle of carbon fibers are intertwined. The traversal intertwined strand 510 runs between the longitudinal strands 521 and 522.

In a portion $P_2$ where the traversal intertwined strand 510 and the longitudinal intertwined strand 520 overlap with each other, the traversal intertwined strand 510 is held by the longitudinal strands 521 and 522 in up/down directions (directions perpendicularly crossing the plane of the net 501).

In the above structure, the traversal intertwined strand 510 hardly deviates at the portion $P_2$ where the intertwined strands 510 and 520 of two axes overlap with each other, i.e., portions forming corners of quadrangular meshes 501*a*.

Thus, similarly to the third embodiment, the present modification adopting a biaxial woven fabric as the net 501 prevents the meshes 501*a* from deviating without a need of fixing the net 501 to the frame, while strengthening the net 501 itself. Further, when the present modification is compared with the net 301 of the modification 2, the number of twists of each of the intertwined strand 510 and 520 (strands of the longitudinal axis and the traversal axis) is more than that of the intertwined strands 310 and 320 (strands of the longitudinal axis and the traversal axis) of the modification 2. As such, this modification achieves a higher strength than that of the net 301 of the modification 2 while restraining deviation of the meshes 501*a*.

Fourth Embodiment

Figure 7:
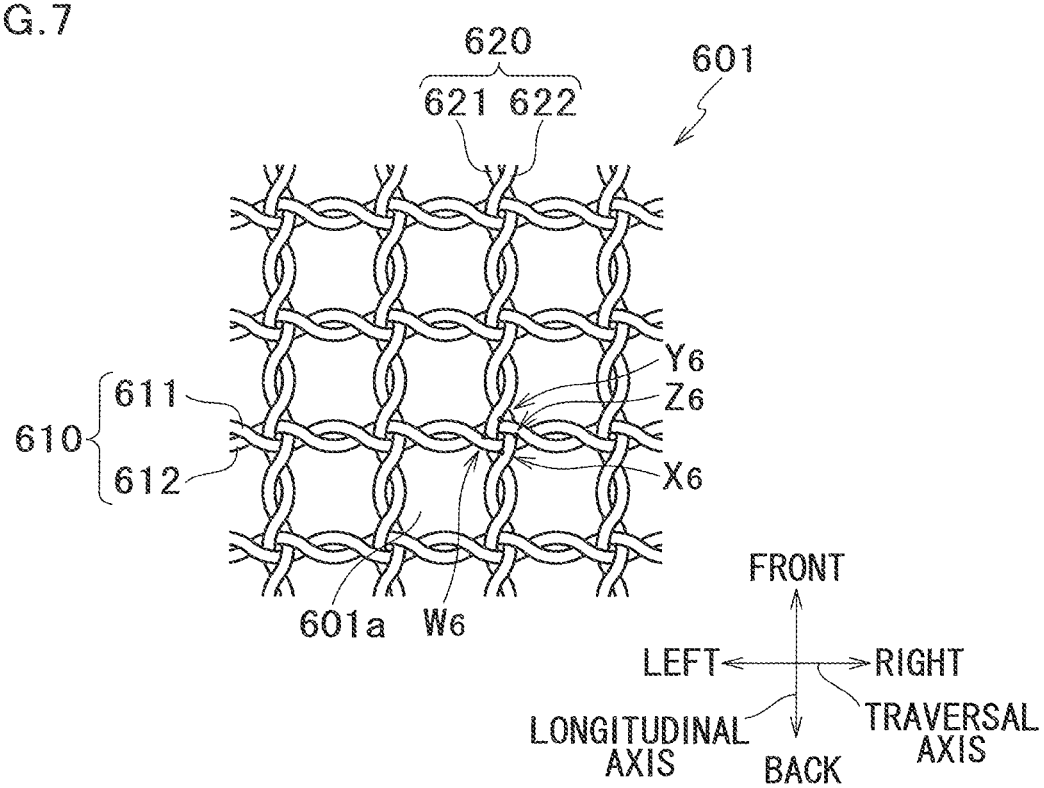
FIG. 7 is a partially enlarged view of a net of a heat treatment furnace jig related to a fourth embodiment.

Next, the following describes a fourth embodiment with reference to FIG. 7. The fourth embodiment differs from the first embodiment in the structure of a net 601.

The net 601 is biaxial woven fabric and intertwined strands 610 and 620 are used for the traversal axis and the longitudinal axis. Further, the net 601 is impregnated with a matrix material.

In each traversal intertwined strand 610, two strands 611 and 612 are leniently intertwined. In each longitudinal intertwined strand 620, two strands 621 and 622 are leniently intertwined.

The traversal strand 611 runs between longitudinal strands 621 and 622. The traversal strand 612 runs between longitudinal strands 621 and 622.

The longitudinal strand 621 runs between traversal strands 611 and 612. The longitudinal strand 622 runs between the traversal strands 611 and 612.

In a portion where the longitudinal intertwined strand 610 and the traversal intertwined strand 620 overlap with each other, the traversal strand 611 is held by the longitudinal strands 621 and 622 in radial directions (directions perpendicularly crossing the plane of the net 601 (up/down directions)). As a result, the traversal strand 612 is held in the radial directions by the longitudinal strands 621 and 622. Further, the longitudinal strand 621 is held in the radial directions by the traversal strands 611 and 612. Further, the longitudinal strand 622 is held in the radial directions by the traversal strands 611 and 612.

Three strands, i.e., the traversal strand 611 and the longitudinal strands 621 and 622 are in contact with each other at contact point $X_6$. At the contact point $X_6$, the lower side line of the traversal strand 611 contacts an area where the longitudinal strands 621 and 622 intersect.

Three strands, i.e., the traversal strand 612 and the longitudinal strands 621 and 622 are in contact with each other at a contact point $Y_6$. At the contact point $Y_6$, the upper side line of the traversal strand 612 contacts an area where the longitudinal strands 621 and 622 intersect. The contact point $X_5$ and the contact point $Y_6$ are positioned opposite to each other over the traversal intertwined strand 610.

With the structure, the traversal intertwined strand 610 is held in the front/back directions by the longitudinal strands 621 and 622.

Three strands, i.e., the longitudinal strand 621 and the traversal strands 611 and 612 are in contact with each other at a contact points $Z_6$. At the contact point $Z_6$, the right side line of the longitudinal strand 621 contacts an area where the traversal strands 611 and 612 intersect.

Three strands, i.e., the longitudinal strand 622 and the traversal strands 611 and 612 are in contact with each other at a contact point $W_2$. At the contact point $W_6$, the left side line of the longitudinal strand 622 contacts an area where the traversal strands 611 and 612 intersect.

With the structure, the longitudinal intertwined strand 620 is held in the left/right directions by the traversal strands 611 and 612.

In the above structure, the traversal strands 611 and 612 and the longitudinal strands 621 and 622 are held by the other strands in the up/down directions, the front/back directions, and the left/right directions, in the vicinity of contact points $X_6$, $Y_6$, $Z_6$, and $W_6$, i.e., portions forming corners of quadrangular meshes 601*a*. Further, portions forming the corners of other meshes have the similar structure. Therefore, the meshes are hardly deviated.

Thus, the present embodiment adopting a biaxial woven fabric as the net 601 prevents the meshes 601*a* from deviating without a need of fixing the net 601 to the frame, while strengthening the net 601 itself. Further, while the modification 1 deals with a case where the longitudinal strand 320 does not run between the traversal strands 311 and 312, the longitudinal strands 621 and 622 run between the traversal strands 611 and 612 in the present modification. Therefore, the longitudinal strands 621 and 622 are restrained more from moving in the left/right directions as compared with the modification 1. Therefore, deviation in the meshes 601*a* is more unlikely than the modification 1.

[Modification 3]

Figure 8:
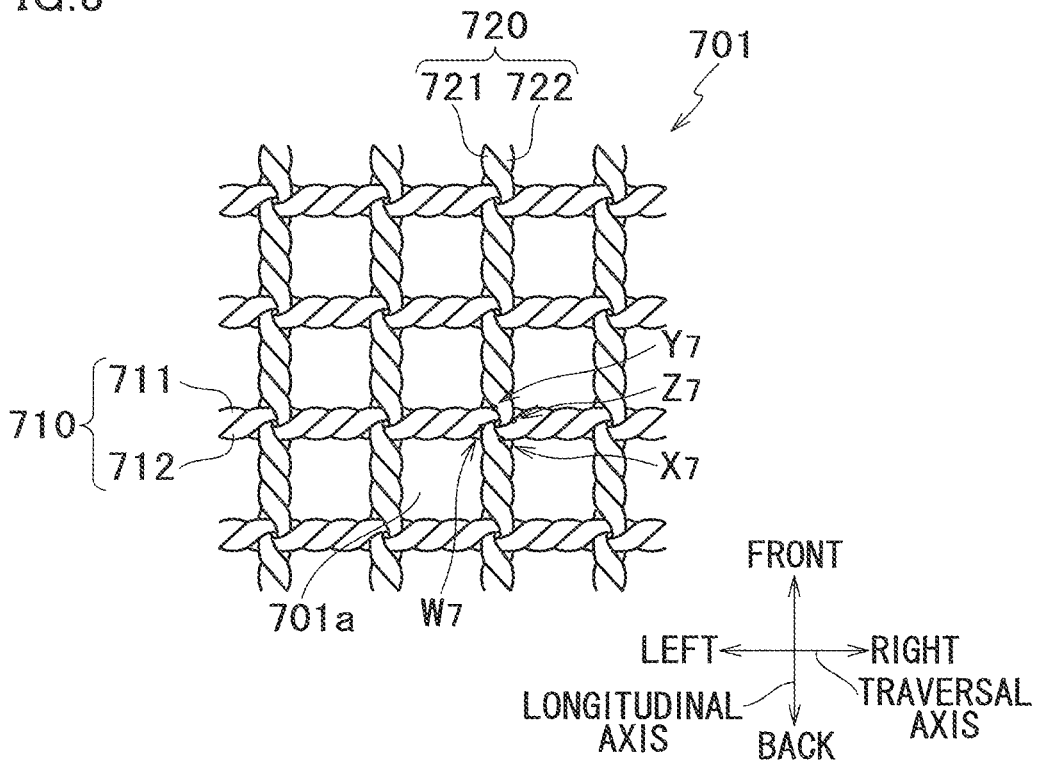
FIG. 8 is a partially enlarged view of a net of a modification of the fourth embodiment.

Next, the following describes another modification of the third embodiment with reference to FIG. 8. The modification 3 is different from the fourth embodiment in the number of twists (twist strength) of the strands of the longitudinal axis and the traversal axis in the net 701 (intertwined strands 710 and 720).

In each traversal intertwined strand 710, two strands 711 and 712 are intertwined. In each longitudinal intertwined strand 720, two strands 721 and 722 are intertwined. The number of twists in the intertwined strands 710 and 720 (strands of the longitudinal axis and the traversal axis) is more than that of the intertwined strands 610 and 620 of the third embodiment, and the intertwined strands 710 and 720 are twisted twice (where each twist is 360°) in each pitch (between adjacent strands of the longitudinal axis, between adjacent strands of the traversal axis).

The traversal strand 711 runs between longitudinal strands 721 and 722. The traversal strand 712 runs between longitudinal strands 721 and 722.

The longitudinal strand 721 runs between traversal strands 711 and 712. The longitudinal strand 722 runs between the traversal strands 711 and 712.

In a portion where the traversal intertwined strand 710 and the longitudinal intertwined strand 720 overlap with each other, the traversal strand 711 is held by the longitudinal strands 721 and 722 in radial directions (directions perpendicularly crossing the plane of the net 701 (up/down directions)). As a result, the traversal strand 712 is held in the radial directions by the longitudinal strands 721 and 722. Further, the longitudinal strand 721 is held in the radial directions by the traversal strands 711 and 712. Further, the longitudinal strand 722 is held in the radial directions by the traversal strands 711 and 712.

Three strands, i.e., the traversal strand 711 and the longitudinal strands 721 and 722 are in contact with each other at a contact point $X_7$. At the contact point $X_7$, the lower side line of the traversal strand 711 contacts an area where the longitudinal strands 721 and 722 intersect.

Three strands, i.e., the traversal strand 712 and the longitudinal strands 721 and 722 are in contact with each other at a contact point $Y_7$. At the contact point $Y_7$, the upper side line of the traversal strand 712 contacts an area where the longitudinal strands 721 and 722 intersect. The contact point $X_7$ and the contact point $Y_7$ are positioned opposite to each other over the traversal intertwined strand 710.

With the structure, the traversal intertwined strand 710 is held in the front/back directions by the longitudinal strands 721 and 722.

Three strands, i.e., the longitudinal strand 721 and the traversal strands 711 and 712 are in contact with each other at a contact point $Z_7$. At the contact point $Z_7$, the right side line of the longitudinal strand 721 contacts an area where the traversal strands 711 and 712 intersect.

Three strands, i.e., the longitudinal strand 722 and the traversal strands 711 and 712 are in contact with each other at a contact point $W_7$. At the contact point $W_7$, the left side line of the longitudinal strand 722 contacts an area where the traversal strands 711 and 712 intersect.

With the structure, the longitudinal intertwined strand 720 is held in the left/right directions by the traversal strands 711 and 712.

In the above structure, the traversal strands 711 and 712 and the longitudinal strands 721 and 722 are held by the other strands in the up/down directions, the front/back directions, and the left/right directions, in the vicinity of contact points $X_7$, $Y_7$, $Z_7$, and $W_7$, i.e., portions forming corners of quadrangular meshes 701*a*.

Thus, similarly to the fourth embodiment, the present modification adopting a biaxial woven fabric as the net 701 prevents the meshes 701*a* from deviating without a need of fixing the net 701 to the frame, while strengthening the net 701 itself.

Further, when the present modification is compared with the net 601 of the third embodiment, the number of twists of each of the intertwined strands 710 and 720 (strands of the longitudinal axis and the traversal axis) is more than that of the intertwined strands 610 and 620 (strands of the longitudinal axis and the traversal axis) of the third embodiment. As such, this modification further strengthens the net 701.

Further, while the modification 2 deals with a case where the longitudinal strand 520 does not run between the traversal strands 511 and 512, the longitudinal strands 721 and 722 run between the traversal strands 711 and 712 in the present modification. Therefore, the longitudinal strands 721 and 722 are restrained more from moving in the left/right directions as compared with the modification 2. Therefore, deviation in the meshes 701*a* is more unlikely than the modification 2.

Fifth Embodiment

Figure 9:
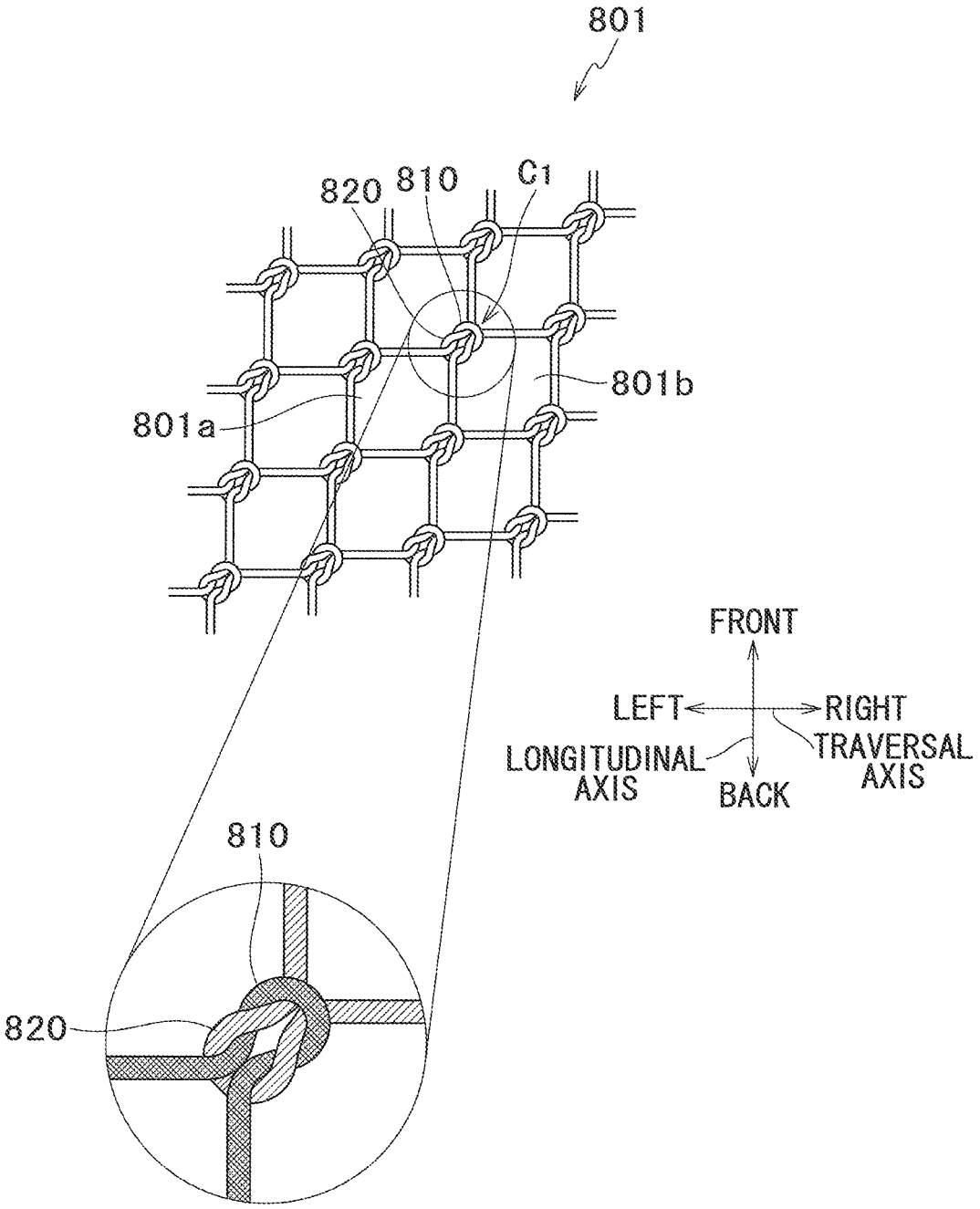
FIG. 9 is a partially enlarged view of a net of a heat treatment furnace jig related to a fifth embodiment.

Next, the following describes a fifth embodiment with reference to FIG. 9. The fifth embodiment differs from the first embodiment in the structure of a net 801.

Further, the net 801 is a knot net in which a knot is formed at each intersection of the strands (strand-crossing points of the net), and is impregnated with a matrix material. At an intersection $C_1$ of strands 810 and 820, the strands 810 and 820 are knotted. The strands 810 and 820 extends in the front/back directions and the left/right directions, respectively, from the intersection $C_1$. Therefore, it is also possible to express that the strand 810 extending in the front/back directions and the strand 820 extending in the left/right directions are knotted at the intersection $C_1$. Further, it is also possible to express that the strand 810 extending in the left/right directions and the strand 820 extending in the front/back directions are knotted at the intersection $C_1$. The knot is formed at the other intersections. As described, in the net 801, a knot is formed at each intersection of the strands extending in two different directions.

With the present invention, strands 810 and 820 are knotted at the intersection, and the adhesive force at each intersection $C_1$ of the net 801 is improved, thereby preventing deviation of meshes 801*a*, 801*b* . . . while strengthening the net 801 itself. This ensures passages for an oil coolant at a time of dipping the heat treatment furnace jig into an oil tank while enabling stable holding of a workpiece and a long lasting usage.

EXAMPLES

Example 1

Two robings of PAN-based high-strength carbon fibers made of 12000 filaments were twisted 1.5 times within 12 mm (where each twist is 360 degrees), thereby to obtain intertwined yarns (strands) of approximately 2 mm in diameter. The intertwined yarns were used as traversal yarns. Similarly to this, two carbon fiber robings made of 12000 filaments were used as longitudinal yarns, and along with the traversal yarns, a net with the structure shown in FIG. 6 was formed. The pitches of the longitudinal yarns and the traversal yarns were 12 mm, and the number of twists of each longitudinal yarn was 1.5 times at between adjacent traversal yarns (i.e., 12 mm). The carbon fiber net obtained was impregnated with a matrix material by subjecting the net to a CVI process in which $CH_4$ gas was supplied under conditions of 1100° C. and 10 Torr with a flow rate of 101/min., and this state was kept for 100 hours. Thus, a heat treatment furnace jig in the form of net made of C/C composite of Example 1 was obtained.

Comparative Example 1

Two robings of PAN-based high-strength carbon fibers made of 12000 filaments were twisted 1.5 times within 12 mm, thereby to obtain intertwined yarns (strands) of approximately 2 mm in diameter. Apart from the above, a C/C composite material of 10 mm in width×10 mm in thickness was used to form a quadrangular frame of 300 mm×200 mm. To this frame holes of 4 mm in diameter are perforated at a pitch of 12 mm, and a frame for manufacturing a jig was obtained. The above intertwined yarns were put through the holes of the frame for manufacturing a jig so that the strands extend in the longitudinal direction and the traversal direction and intersect with one another within the frame. Thus, there was provided a carbon fiber net having a typical net structure in which each longitudinal yarn passes tops and bottoms of traversal yarns at intersections in an alternating manner (i.e., the traversal yarns are not held by the longitudinal yarns). The net obtained was impregnated with a matrix material through the same method of Example 1, and then taken out from the frame for manufacturing a jig, by cutting the strands at their portions nearby the frame. Thus, a heat treatment furnace jig in the form of C/C composite net of Comparative Example 1 was obtained.

The heat treatment furnace jig of Example 1 was rigid and the traversal yarns and the longitudinal yarns were firmly attached to each other at their intersections, and was not easily broken by application of an impact. This net was set to a C/C composite tray resembling to FIG. 1. To this, an SCR420 steel material was placed and was subjected to carburization at 950° C., and an oil quenching process. The net maintained the original state without a damage or deformation even after the processes. Further, the steel material subjected to the processes was suitably quenched. In the heat treatment furnace jig of Comparative Example 1 on the other hand, the longitudinal yarns and the traversal yarns were made rigid by the matrix material; however, the adhesive force between the traversal yarns and the longitudinal yarns was weak, and the rectangular net easily deformed into a parallelogram. The net therefore was not practically usable as the heat treatment furnace jig.

While the present invention has been described with reference to embodiments, modifications, and figures, it is evident that many alternatives, modifications and variations will be apparent to those skilled in the art. Accordingly, the preferred embodiments of the present invention as set forth above are intended to be illustrative, not limiting. Various changes may be made without departing from the spirit and scope of the invention as defined in the following claims.

For example, the above embodiments and modifications each deal with a case where the net of the jig is either biaxial woven fabric or triaxial woven fabric. However, the net may be multi-axial woven fabric of quadraxial or more. Further, the structure of the net is not limited to those described in the above embodiments and modifications, and may be altered.

Further, the first embodiment deals with a case where strands of carbon fibers aligned without twist are used as the strands 10, 20, 30, and 40 of the net 2 of the heat treatment furnace jig 100; however, it is possible to adopt intertwined strands (in which carbon fibers and strands are twisted together).

Further, the above embodiments and modifications deal with cases where the net of the jig is impregnated with a matrix material; however, the net does not necessarily have to be impregnated with a matrix material.

Further, in the second embodiment, third embodiment, fourth embodiment, and modifications of these embodiments, the intertwined strands each includes two strands twisted together; however, it is possible to adopt intertwined strands each of which includes three or more strands twisted together. Further, in the fourth embodiment and the modifications 1 to 3, it is possible to adopt, as the strands of the longitudinal axis or the strands of the traversal axis, an intertwined strand made by twisting a single strand.

The number of twists of each intertwined strand is not limited to those illustrated in FIG. 3 to FIG. 8 and may be suitably altered according to the pitch of grid, the diameter of strands, the number of carbon fiber filaments, the pitch of meshes, and the like. For example, when 12,000 filaments are used to make a net of approximately 10 mm in pitch, the number of twists is 0.5 to 10 times, preferably once to 5 times, more preferably 1.5 times to 3 times. Although it is preferable that the number of twists be increased with a decrease in the number of filaments and/or an increase in the pitch of the meshes, the number of twists is not limited to those described in the above examples.

The fifth embodiment deals with a case where knots are formed at an intersection of two strands (see FIG. 9); however, it is possible to form knots at intersection of three or more strands. Further, the tightness of the knot portions of the strands is not limited to that shown in FIG. 9. For example, it is possible to the strands may be knotted tighter than the one shown in FIG. 9.

Further, the size of the meshes and the shape of the knot are not limited to those described in the above embodiments and modifications, and may be altered.

LISTING OF REFERENCE NUMERALS

2, 201, 301, 401, 501, 601, 701. Net
10. first Strand
20. second Strand
30. third Strand
40. fourth Strand
50. fifth Strand
220, 320, 420, 510, 520, 610, 620, 710, 720. Intertwined Strand
2*a*, 2*b*, 201*a*, 201*b*, 301*a*, 401*a*, 401*b*, 501*a*, 601*a*, 701*a*. Mesh
61, 62, 63, 64, 65, 66. Area
100. Heat Treatment Furnace Jig

The invention claimed is:

1. A heat treatment furnace jig, comprising:
a box-like frame including a rim part and a bottom part, the bottom part being removable from the rim part;
a removable net of woven strands which are each a bundle of carbon fibers, the net of woven strands supported from below by the bottom part and disposed in the box-like frame, wherein
the net is impregnated with a matrix material, and among the woven strands, strands of at least one direction are each held by two strands of another direction,
wherein the net is biaxially woven, and intertwined strands extend in at least one axis, each of the intertwined strands formed by twisting together two woven strands, and
wherein the intertwined strands in one axis run through intertwined strands in another axis.

2. The heat treatment furnace jig according to claim 1, wherein the matrix material mainly contains carbon.

3. The heat treatment furnace jig according to claim 2, wherein the matrix material contains carbon derived from pitch or a resin.

4. The heat treatment furnace jig according to claim 2, wherein the matrix material contains at least pyrolytic carbon.

5. The heat treatment furnace jig of claim 1, wherein the rim part comprises a plurality of removable portions.

6. The heat treatment furnace jig of claim 5, wherein each of the removable portions constitutes a side of a box formed by the rim part.

7. The heat treatment furnace jig of claim 1, wherein the bottom part comprises a plurality of removable planner members forming a grid.

8. The heat treatment furnace jig of claim 7, wherein the grid comprises more than two members that cross each other and that are perpendicular to each other.

9. The heat treatment furnace jig of claim 1, wherein the matrix material is resistant to a temperature of 500° C.

10. The heat treatment furnace jig of claim 1, wherein:
at least one twisted strand in at least one direction is held by at least one twisted strand in another direction; and
each of the at least one twisted strand includes more than one twist.

11. A heat treatment furnace jig, comprising:
a box-like frame including a rim part and a bottom part, the bottom part being removable from the rim part;
a removable net of woven strands which are each a bundle of carbon fibers, the net of woven strands supported from below by the bottom part and disposed in the box-like frame,
wherein the net is impregnated with a matrix material, and
among the woven strands, strands of at least-one direction being held by two strands in another direction, and
wherein the net is triaxially woven, and strands are twisted together to form intertwined strands.

12. The heat treatment furnace jig according to claim 11, wherein, among the plurality of strands, one side line of a first axial strand contacts a vertex of a first area of a quadrangular area where a second axial strand and a third axial strand overlap with each other, and
another side line of the first axial strand contacts a vertex of a second area of a quadrangular area where another second axial strand parallel and adjacent to aforementioned second axial strand overlaps with the third axial strand overlap with each other.

13. The heat treatment furnace jig according to claim 11, wherein the matrix material mainly contains carbon.

14. The heat treatment furnace jig according to claim 12, wherein the matrix material mainly contains carbon.

15. The heat treatment furnace jig according to claim 13, wherein the matrix material contains carbon derived from pitch or a resin.

16. The heat treatment furnace jig according to claim 14, wherein the matrix material contains carbon derived from pitch or a resin.

17. The heat treatment furnace jig according to claim 13, wherein the matrix material contains at least pyrolytic carbon.

18. The heat treatment furnace jig according to claim 14, wherein the matrix material contains at least pyrolytic carbon.

19. A heat treatment furnace jig, comprising:
a box-like frame having a bottom part;
a removable net of woven strands which are each a bundle of carbon fibers, the net of woven strands supported from below by the bottom part and disposed in the box-like frame, wherein
the net is biaxially woven impregnated with a matrix material, and among the woven strands, intertwined strands extend in two axes, wherein the intertwined strands are formed by twisting together strands, and
more than one intertwined strands in one axis run through more than one intertwined strands in another axis.

* * * * *